US008800579B2

(12) United States Patent
Severson et al.

(10) Patent No.: US 8,800,579 B2
(45) Date of Patent: Aug. 12, 2014

(54) HANDGRIP FOR A CRUTCH

(75) Inventors: Keith Severson, Goleta, CA (US); John Russell Stump, Santa Barbara, CA (US)

(73) Assignee: Propel Mobility, Goleta, CA (US)

( * ) Notice: Subject to any disclaimer, the term of this patent is extended or adjusted under 35 U.S.C. 154(b) by 0 days.

(21) Appl. No.: 13/441,695

(22) Filed: Apr. 6, 2012

(65) Prior Publication Data

US 2013/0263901 A1 Oct. 10, 2013

(51) Int. Cl.
*A45B 9/02* (2006.01)
*A61H 3/02* (2006.01)

(52) U.S. Cl.
USPC ..... 135/72

(58) Field of Classification Search
USPC ..... 135/72, 76
See application file for complete search history.

(56) References Cited

U.S. PATENT DOCUMENTS

| | | | | |
|---|---|---|---|---|
| 1,192,290 | A | 7/1916 | Engstrom | |
| 1,303,721 | A | 5/1919 | Plouffe | |
| 1,459,333 | A | 6/1923 | Hipwood | |
| 3,269,399 | A | 8/1966 | Smith | |
| 3,517,678 | A * | 6/1970 | Gilsdorf | 135/72 |
| 4,572,227 | A | 2/1986 | Wheeler | |
| 4,625,743 | A * | 12/1986 | Harker | 135/68 |
| 5,025,820 | A | 6/1991 | Gamper | |
| 5,417,234 | A * | 5/1995 | Davis | 135/68 |
| 5,606,985 | A | 3/1997 | Battiston et al. | |
| 5,791,360 | A * | 8/1998 | Battiston et al. | 135/68 |
| 7,591,275 | B2 * | 9/2009 | Baker | 135/72 |
| 7,657,972 | B2 | 2/2010 | Jenkins | |
| 7,735,500 | B2 | 6/2010 | Jacobs et al. | |
| 2006/0081280 | A1 * | 4/2006 | Fair | 135/76 |
| 2008/0173340 | A1 | 7/2008 | Robbins | |

* cited by examiner

*Primary Examiner* — Noah Chandler Hawk
(74) *Attorney, Agent, or Firm* — Mark Rodgers

(57) ABSTRACT

An improved hand grip for an ambulatory crutch. The improved handgrip is offset from the plane of the crutch with the forward end of the grip lower than the rear end of the grip, and with the rear end offset larger than the forward end. The handgrip has a curve outward from the plane of the crutch and preferably is made of or molded over with an ergonomically shaped weight bearing material and/or air bladder. The combination of offsets and angles provides significantly improved wrist/arm orientation compared to conventional crutch handgrips resulting in less fatigue and usage injury.

11 Claims, 21 Drawing Sheets b a

HANDGRIP FOR A CRUTCH

RELATED APPLICATIONS

Not Applicable

FEDERALLY SPONSORED RESEARCH

Not Applicable

SEQUENCE LISTING

Not Applicable

BACKGROUND OF THE INVENTION

The invention relates to ambulatory crutches and in particular an improved handgrip, which is attached to the crutch in a unique orientation chosen ergonomically to reduce fatigue and usage injury.

Walking with conventional axillary crutches creates harsh forces on the body. These forces are transferred directly from the foot of the crutch to the wrist and hand. Through the dynamic motion of the crutch gait there are moments when the hands take on the full body weight. The standard axillary crutch has a grip that is in plane and 90 degrees to the axis of the crutch. This causes the hand to be bent between 90 to 110 degrees sharply at the wrist. Stresses are indirectly transferred into the ligaments and nerves within the wrist by means of a vertical and horizontal force.

Thus normal crutch grips place the wrist in a severely extended position, as shown in FIGS. 10*a*, 11*a*, and 12*a*. Along with increasing fatigue, this unnatural position puts the wrist at risk for common injuries such as tendonitis, carpal tunnel syndrome, sprains and strains. The common muscles at risk for sprains and strains are the flexor digitorum profundus, flexor digitorum superficialis and flexor carpi ulnaris. While muscle hyper flexion occurs, direct and indirect force is placed on the carpal ligaments the carpal bones and on key nerves such as the median, radial, and ulnar. In addition the weight and shock bearing of the arm and shoulder are affected by these angles leading to overall body fatigue. Thus crutch users often find themselves in treatment and rehabilitation for injuries caused by the use of the crutches themselves. The common medical term for this type of injury is Crutch Paralysis.

There is a need for a crutch grip that places the wrist in a comfortable, neutral position, by improving the length/tension relationship of the engaged muscles to allow for optimal performance and reduced injury. Such a position would set the tone and foundation for better posture and alignment for those using crutches. Improved posture will not only decrease the potential for wrist pain but also for back and shoulder pain by keeping the whole upper extremity in proper alignment. Also, the improvement in posture will lead to improvements in confidence and efficiency in movement using the crutches. Thus it is the object of this invention to provide for both new crutches and as retrofits for existing crutches a novel handgrip device which achieves a neutral, length/tension optimized wrist position to alleviate crutch related injuries and improve crutch user endurance.

BRIEF SUMMARY OF THE INVENTION

The invention is a handgrip device for an ambulation assistance crutch. The crutch is of a conventional type made of wood, metal or composites, having two support poles extending from the top of the crutch downward toward the ground. The invention includes a handgrip element and one handgrip element support pole attachment mechanism for each pole, forward (thumb side) and rear, bridged by the handgrip element. The attachment mechanisms are preferably user installable and removable, and provide a support for the handgrip element spaced outboard from the plane of the poles opposite the body side of the crutch by an offset distance. When installed on the crutch, the offset distance from the forward tube (thumb end) end of the handgrip is less than the offset distance from the rear tube. The vertical positioning of the forward end of the handgrip is lower to the ground then the back end vertical positioning of the handgrip. The handgrip element is curved outward relative to the plane of the support poles. The handgrip element is at least one of made or encased in a molded ergonomic grip shape for improved weight distribution. The device is preferably user installable and removable without tools.

The offset distance from the forward tube is in the range of 0.5" to 2.5" and preferably is 1.33"+/−0.5". The offset distance from the rear tube is in the range of 1.0" to 3.0" and preferably is 1.95"+/−0.5".

The angle of the handgrip element due to the difference between the back and front end vertical positioning is between 5 and 20 degrees down from rear to front and preferably is 14+/−1 degrees down from rear to front. The handgrip element has a radius of curvature between 5 and 50 inches.

The device may also include at least one attachment for external items, including shopping bags, handbags, and carrying cases. In some embodiments, the device includes a cushioned handgrip with a stiffer material internal to the grip and a softer material in the outer portion in contact with the hand. I certain embodiments, the grip firmness may be adjustable with an internal user-pumped, vent-able airbladder.

BRIEF DESCRIPTION OF THE DRAWINGS

The invention will be better understood by referring to the following figures.

FIG. 9 shows various views of a crutch 1 with the invention employed. In particular, in the area where the handgrip 2 is installed, there are two crutch poles extending from the top crutch pad of the crutch toward the ground, 1*a*, the forward (thumb side) pole and 1*b* the rear pole. In the region before the poles merge, the poles form a plane. Herein inboard of the plane of the poles is defined as toward the body and outboard is defined as away from the body. The vertical direction is defined as the vertical axes of the crutch extending from the shoulder pad to the foot. Handgrip 2 is typically mounted outboard (away from body) of the plane formed by poles 1*a* and 1*b*.

FIGS. 1-4 illustrate in simplified views the important aspects of the novel handgrip device. In all views, a forward mounting mechanism 3*a* mounts handgrip element 2 to forward pole 1*a*, and a rear mounting mechanism 3*b* mounts handgrip 2 to rear pole 1*b*, with handgrip element 2 bridging between the mounting elements. In all views shown, mounting mechanism 3*a* and 3*b* extend more or less perpendicular outboard (away from body) from the plane of the poles. However one skilled in the art will recognize that the exact angle of mounting mechanism relative to the plane is not important as long as the handgrip element is long enough for a sufficient range of hand sizes.

Four handgrip geometry constraints are needed to achieve the goals of the invention. First mounting mechanisms 3*a* and 3*b* must offset the handgrip element 2 from the plane of the crutch poles. Second, the offset distance from the front pole 1*a* must be less than the offset distance from the rear pole 1*b*. Third, The vertical positioning of attachment point to the grip of the rear mount must be higher from the foot of the crutch than the front attachment point, ie the grip must be angled down from rear to front. Fourth, the handgrip element 2 itself must have a radius of curvature with the center of the curve toward the body, ie the grip must curve outward between the attachment points.

Figure 13:
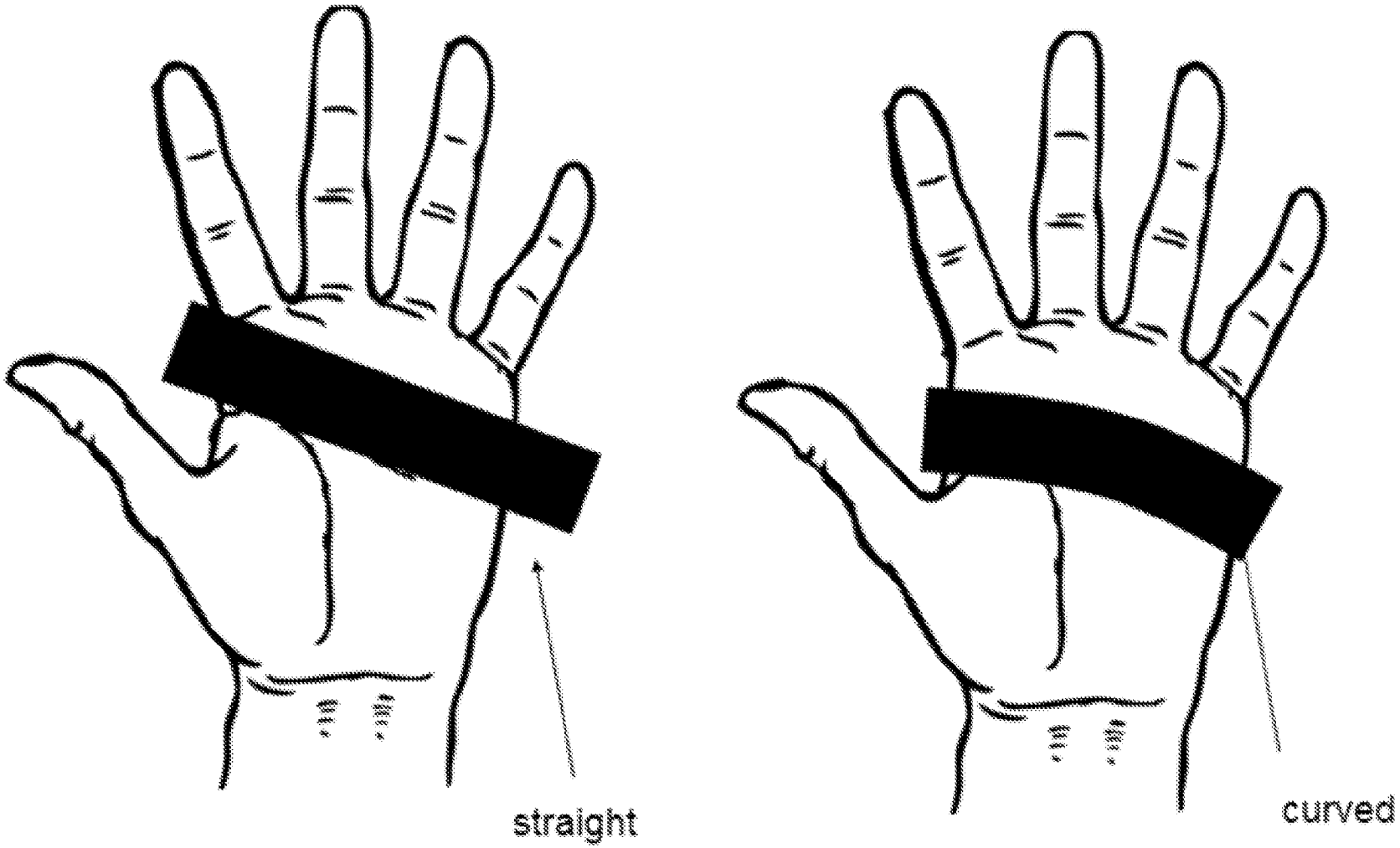
FIG. 13 illustrates how a curved handgrip follows hand contours compared to a straight handgrip.
Figure 14:
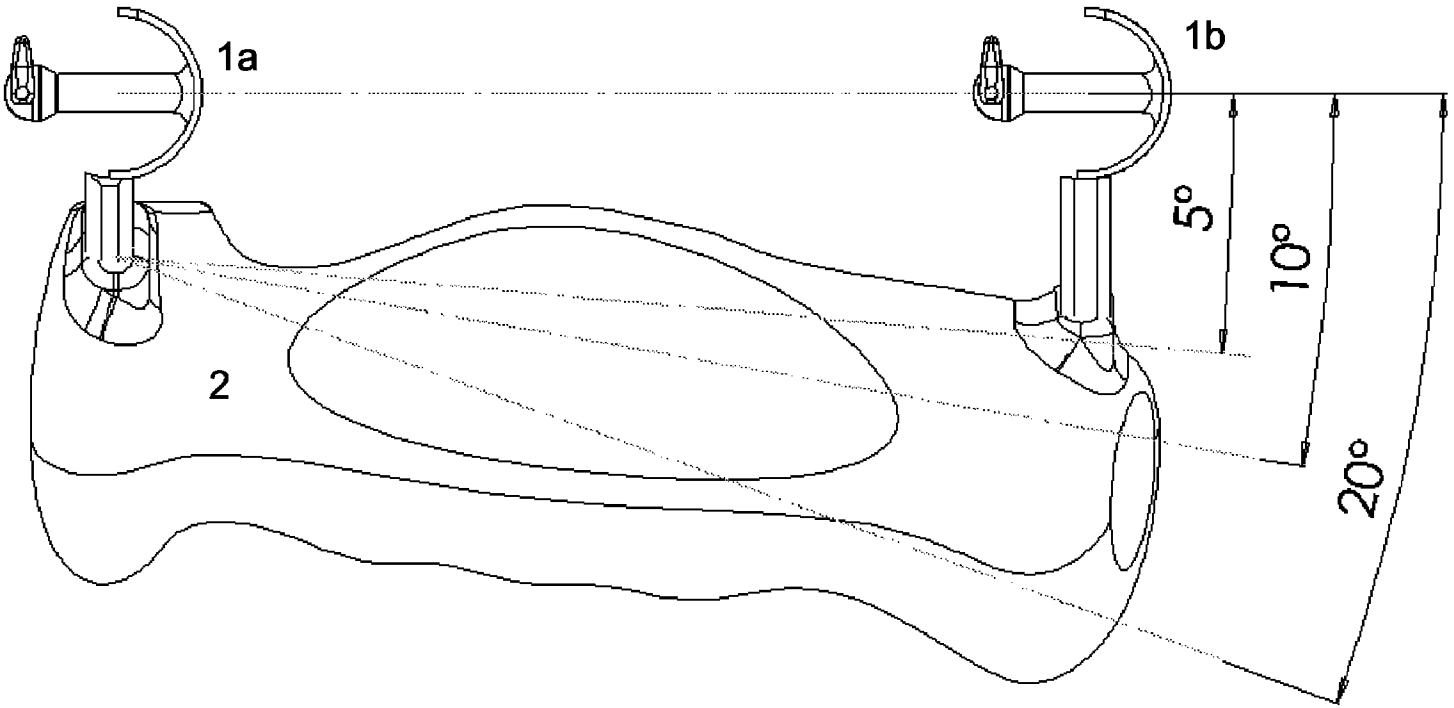
FIGS. 14-17 are various views of the handgrip device showing ideal and acceptable ranges for the various angles, curvatures and offset distances.
Figure 15:
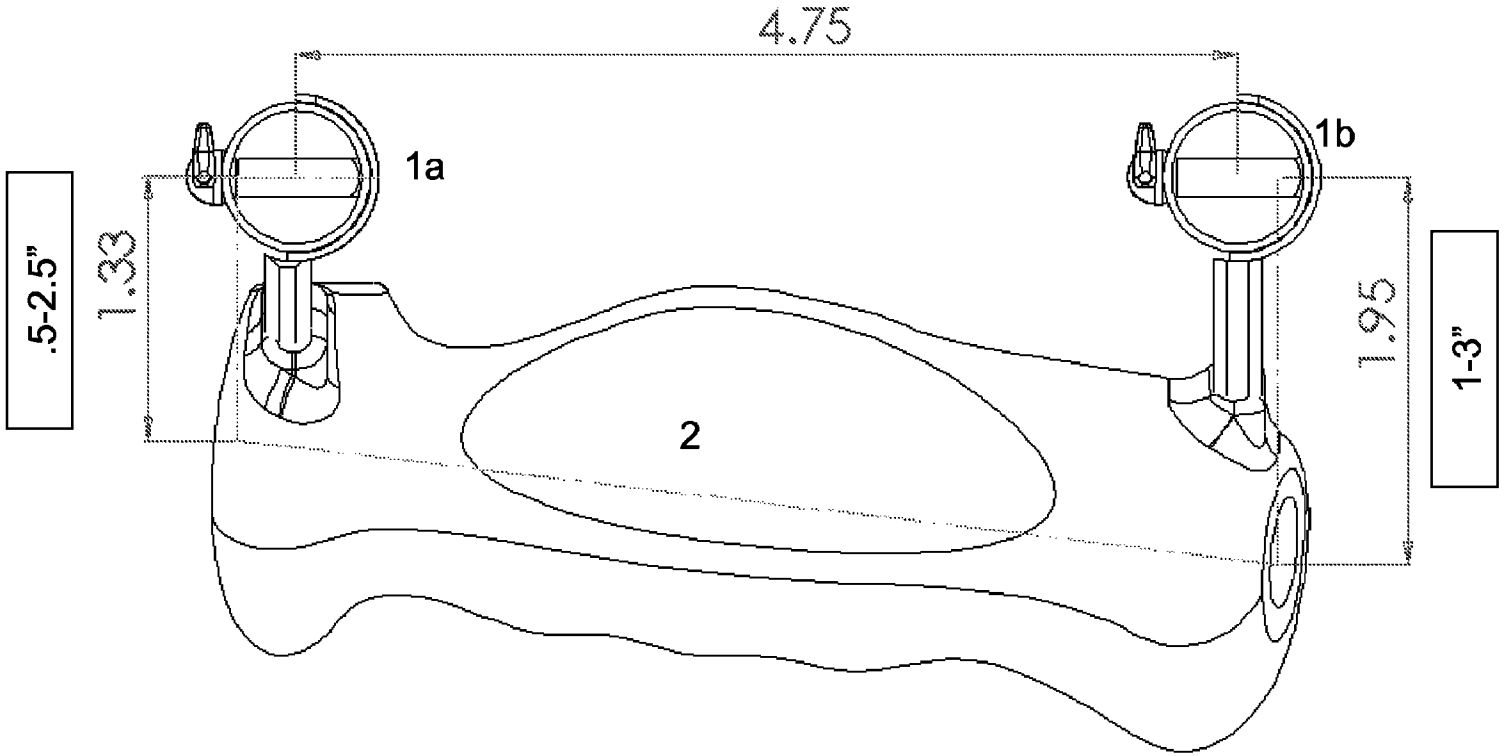
Figure 16:
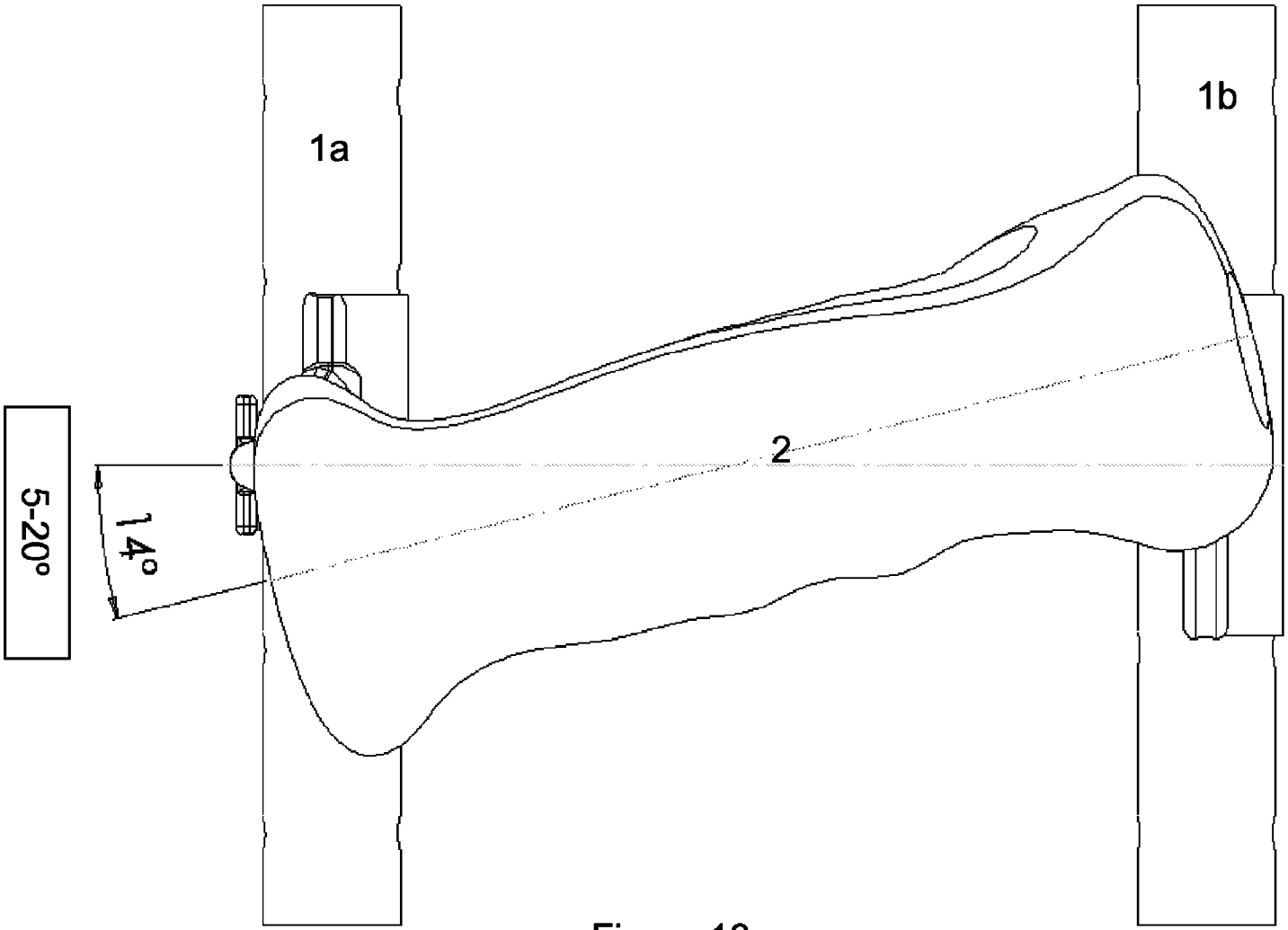
Figure 17:
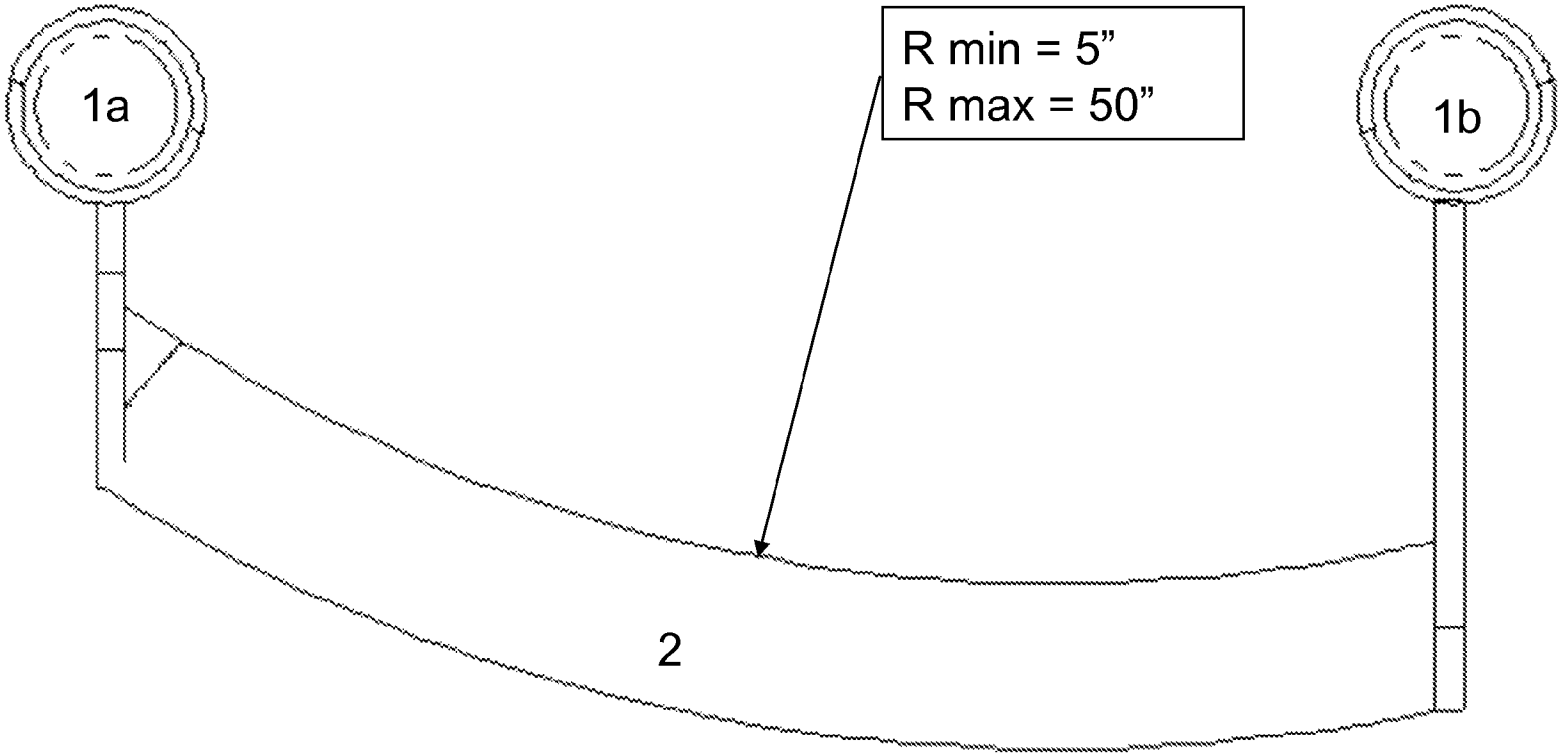

A handgrip geometry as described achieves the following. The wrist naturally should be in slight ulnar deviation as opposed to radial deviation as it is during axillary crutch walking. By angling the grip downward approx 15 degrees, the wrist supports body weight with less injury as the wrist is closer to the body's neutral position. By offsetting the grip off plane, the hand is spaced off the body further and the larger offset to the rear matches the wrists natural weight bearing orientation. This allows the crutch to be less angled (more vertical in use). Keeping the crutch more vertical means it is less likely to slip, and provides a more efficient ambulation for the user. A slightly curved grip matches the shape of the human hand. This allows for a more ergonomic fit as shown in FIG. 13. Natural ergonomic hand orientation reduces strain on tendons and nerves within the metacarpal and phalanges. This reduction in strain is also beneficial for injury reduction and reduces extra energy output from the patient.

The inventors have determined the following actual dimensions for the geometry constrains described above to achieve the desired benefits. The ranges denote numbers that achieve some benefit over conventional designs, while the preferred numbers are the inventor's experimentally determined preferred dimensions. The offset distance from the forward tube is in the range of 0.5" to 2.5" and preferably is 1.33"+/−0.5". The offset distance from the rear tube is in the range of 1.0" to 3.0" and preferably is 1.95"+/−0.5". The angle of the handgrip element due to the difference between the back and front end vertical positioning is between 5 and 20 degrees down from rear to front and preferably is 14+/−1 degrees down from rear to front. The handgrip element has a radius of curvature between 5 and 50 inches This curved feature can also be defined by an ellipse, spline, or other curved geometry. FIGS. 14-17 show these dimensions and ranges in a variety of views of the novel device.

Figure 1:
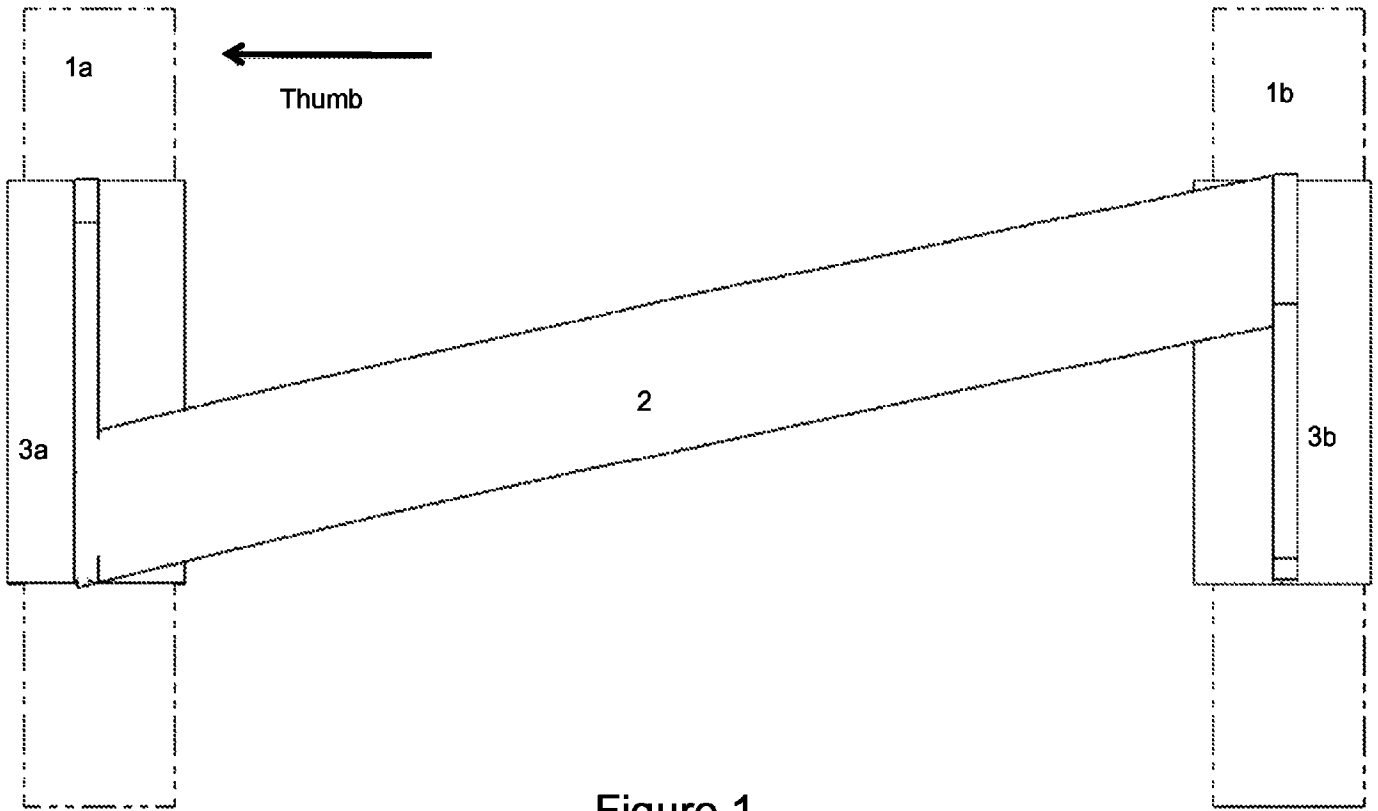
FIG. 1 depicts a simplified view of the novel handgrip looking at the horizontal plane of the crutch poles from the outboard direction.
Figure 2:
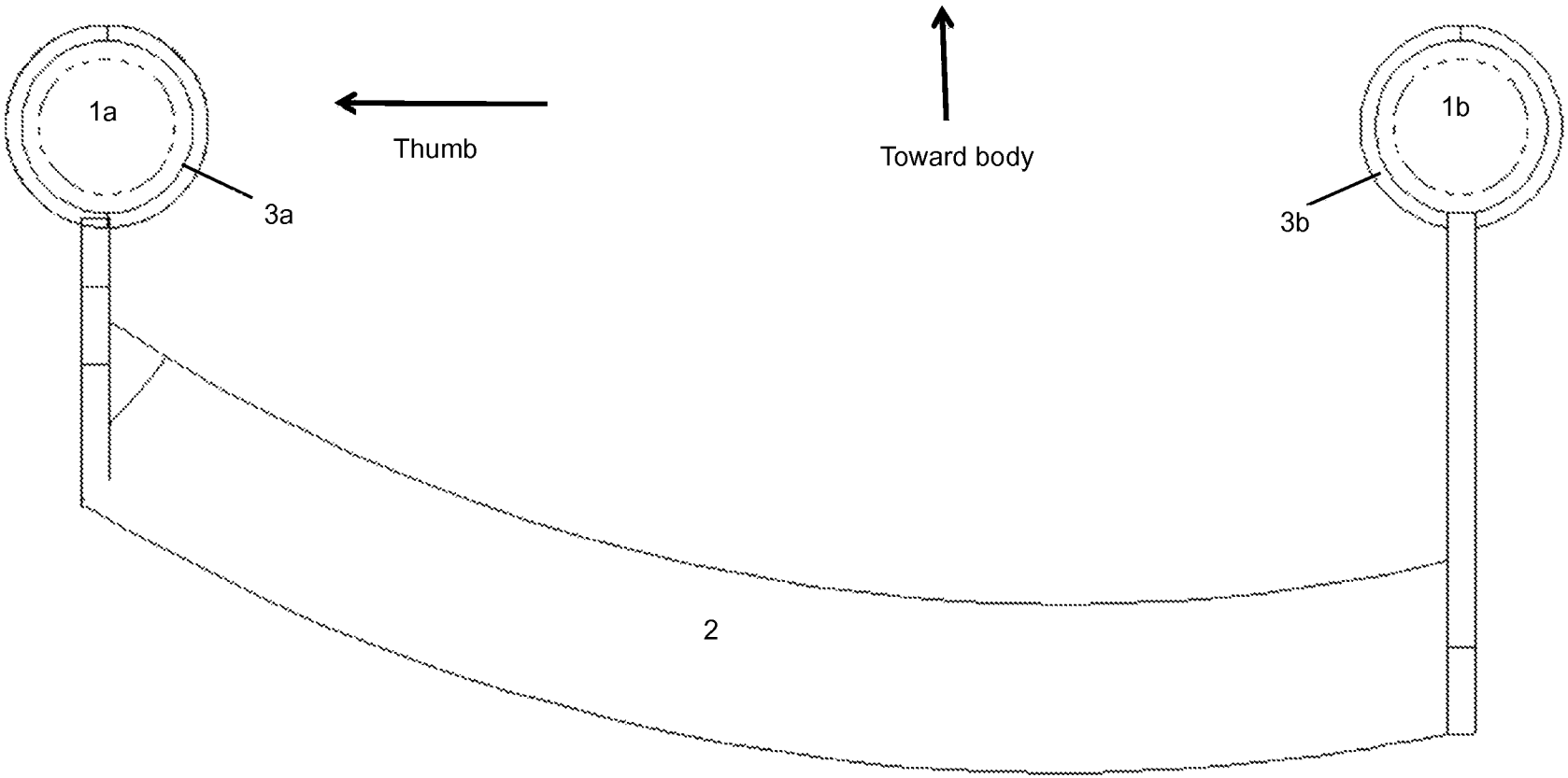
FIG. 2 depicts a simplified view of the novel handgrip looking from above the crutch poles along the vertical axes of the poles.
Figure 3:
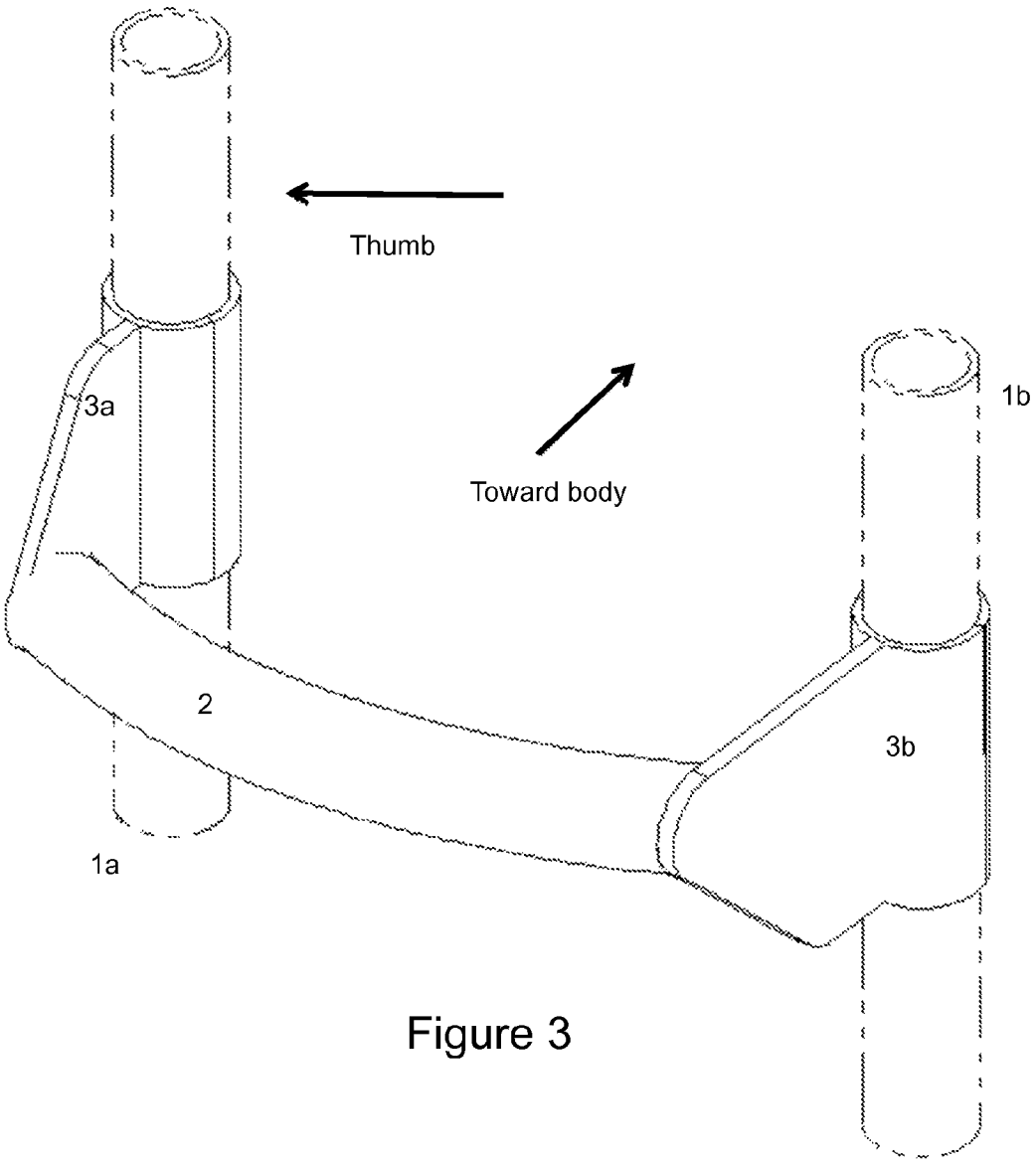
FIG. 3 depicts a simplified view of the novel handgrip looking from the side rear of the crutch.
Figure 4:
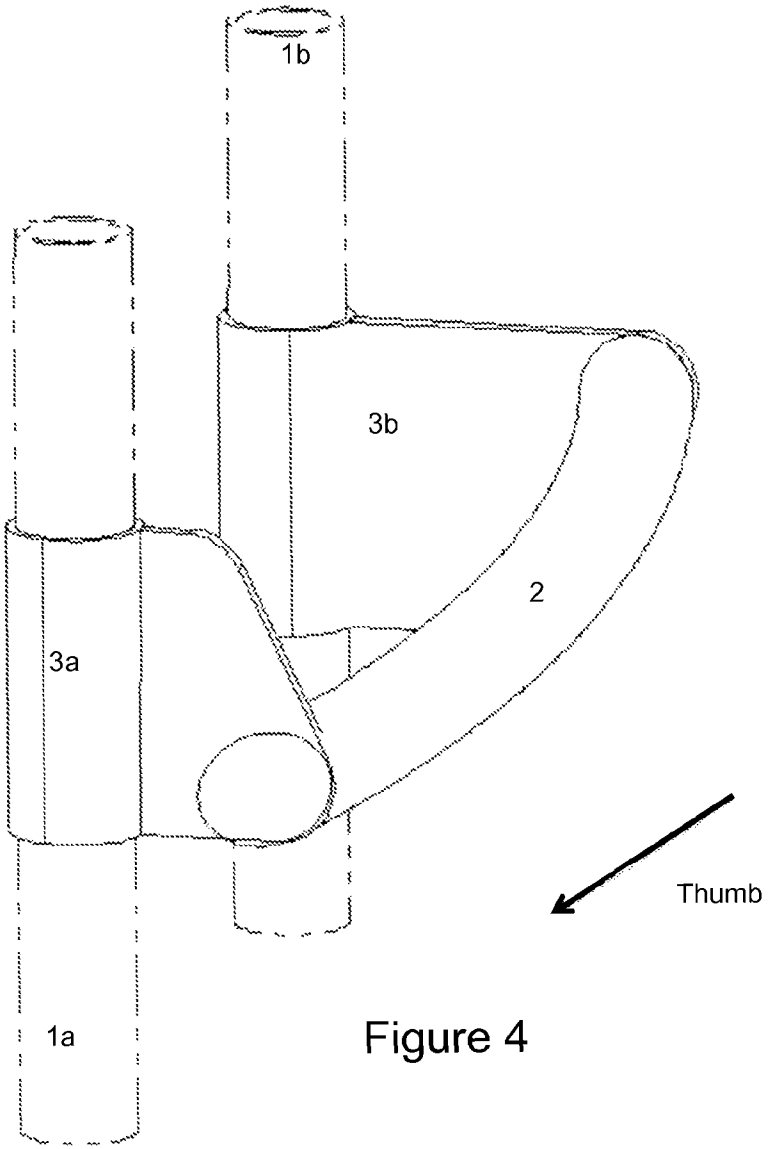
FIG. 4 depicts a simplified view of the novel handgrip looking from the side front of the crutch.
Figure 5:
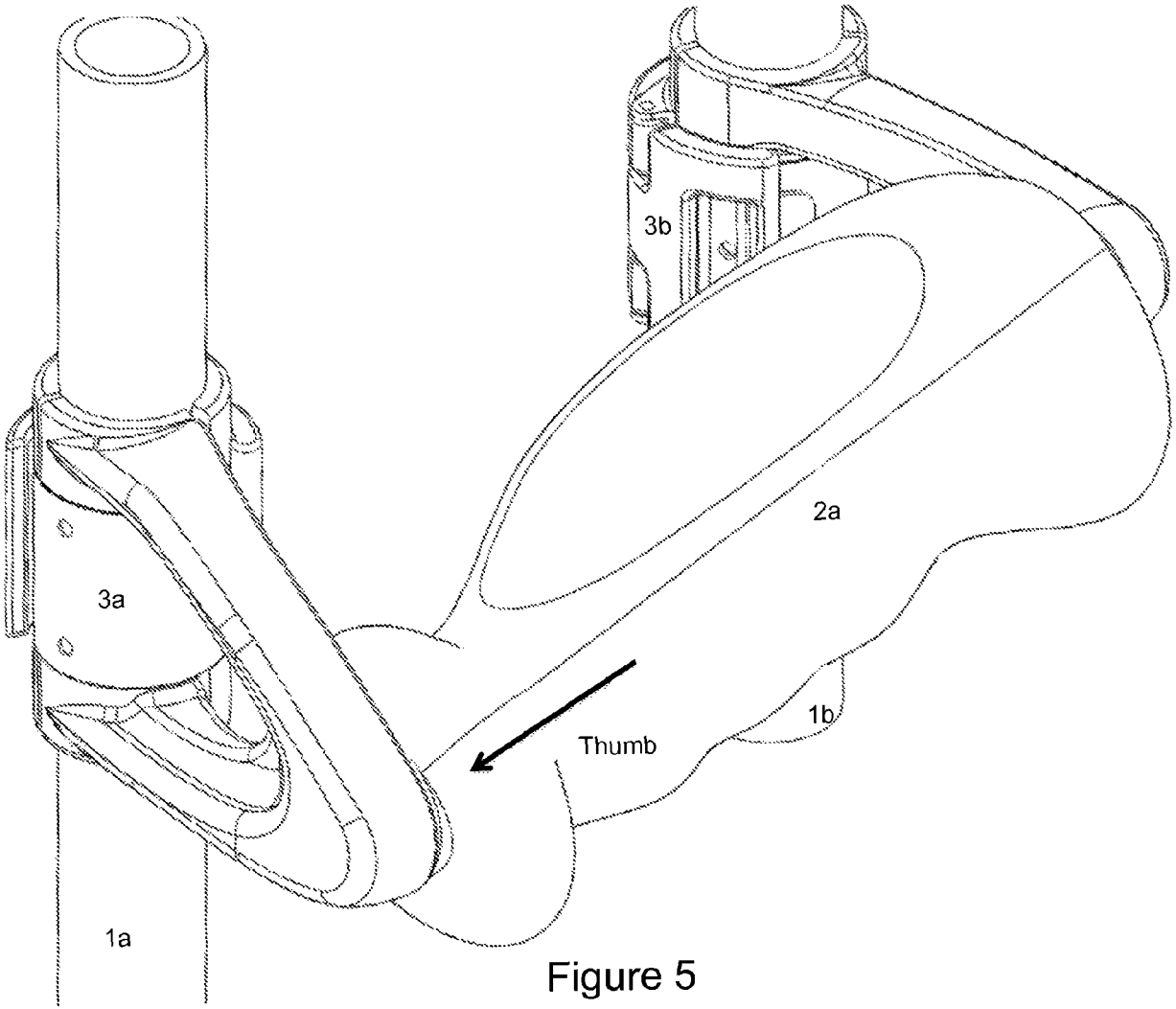
FIG. 5 shows a side front view of the crutch with ergonomic handgrip and wrap around latch mounting mechanisms.

The simplified views shown in FIGS. 1-4 illustrate the basic geometry of the novel handgrip device. One skilled in the art, using those guidelines, will conceive of a number of details in the implementation of the mounting elements and handgrip elements, most of which would result in a functional crutch achieving the desired benefits. However other specific goals of the inventors have led to a variety of particularly useful implementations of the device. FIG. 5 shows handgrip element with an ergonomic molding 2*a*, which further increases weight bearing distribution and comfort. This ergonomic grip could either be over molded or slipped onto to a simple grip or the grip could be manufactured in one piece.

Figure 6:
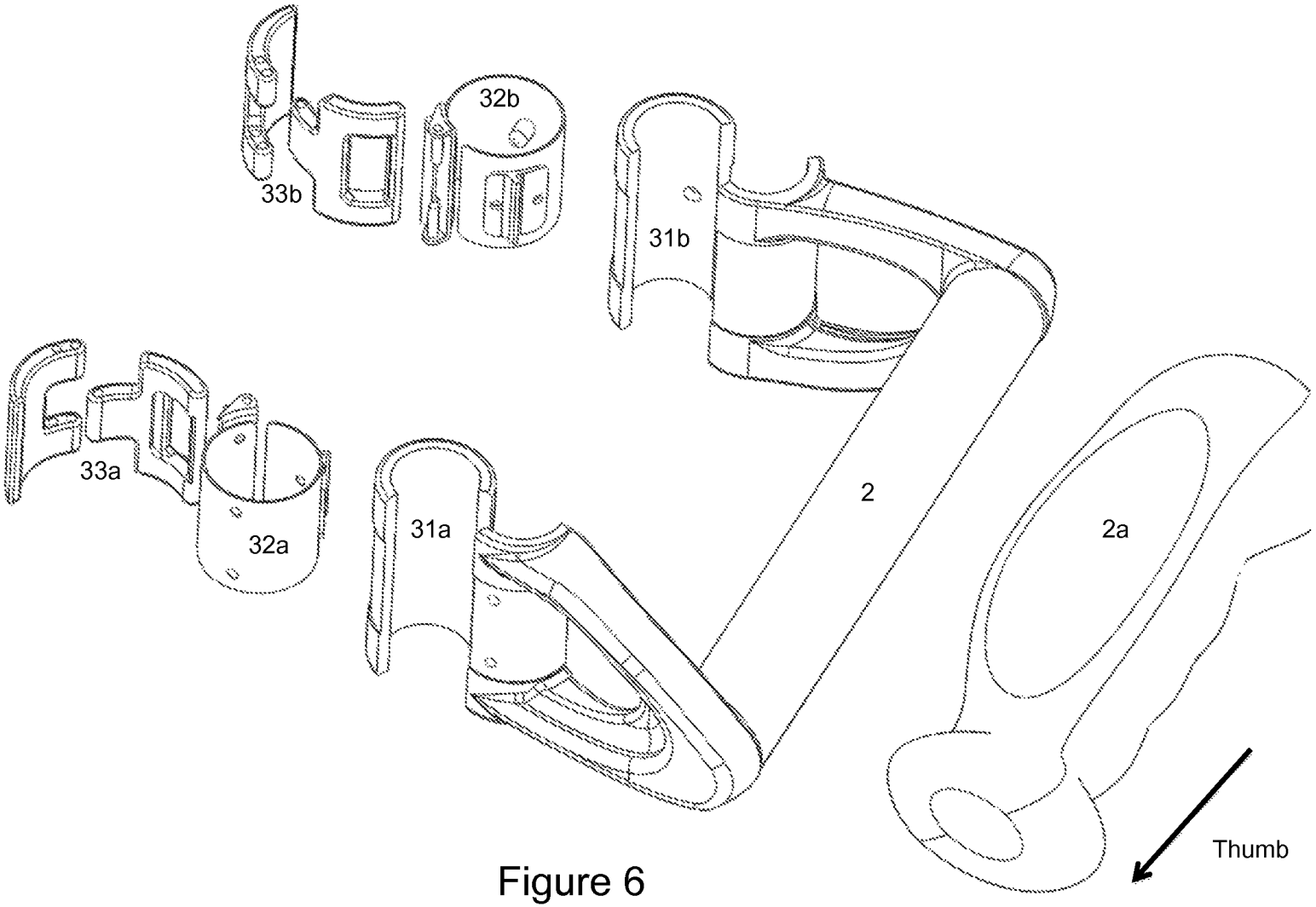
FIG. 6 shows a detailed view of one version of a wrap around mounting mechanism.
Figure 7:
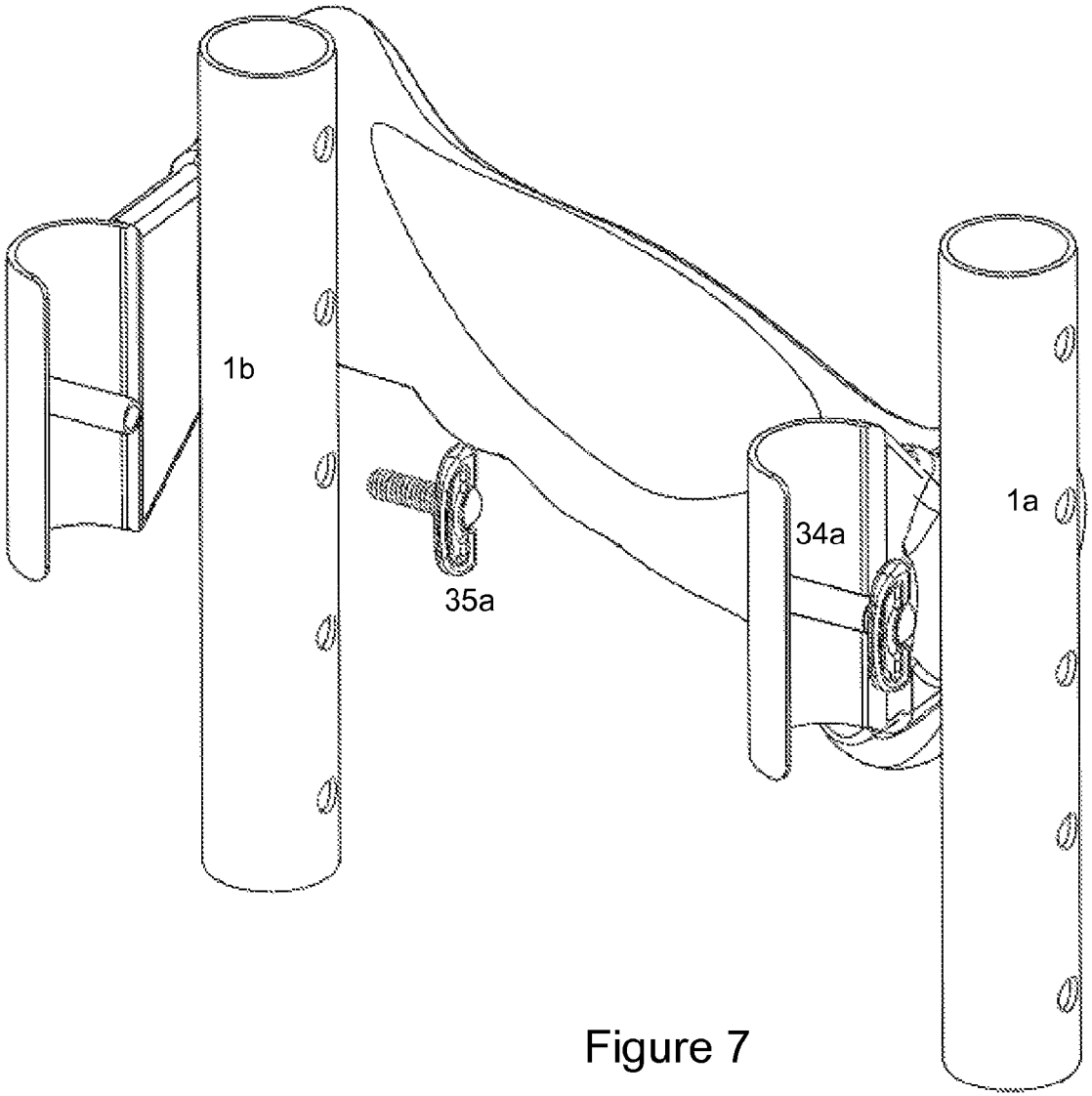
FIG. 7 depicts an alternative threaded pin mounting mechanism.
Figure 8:
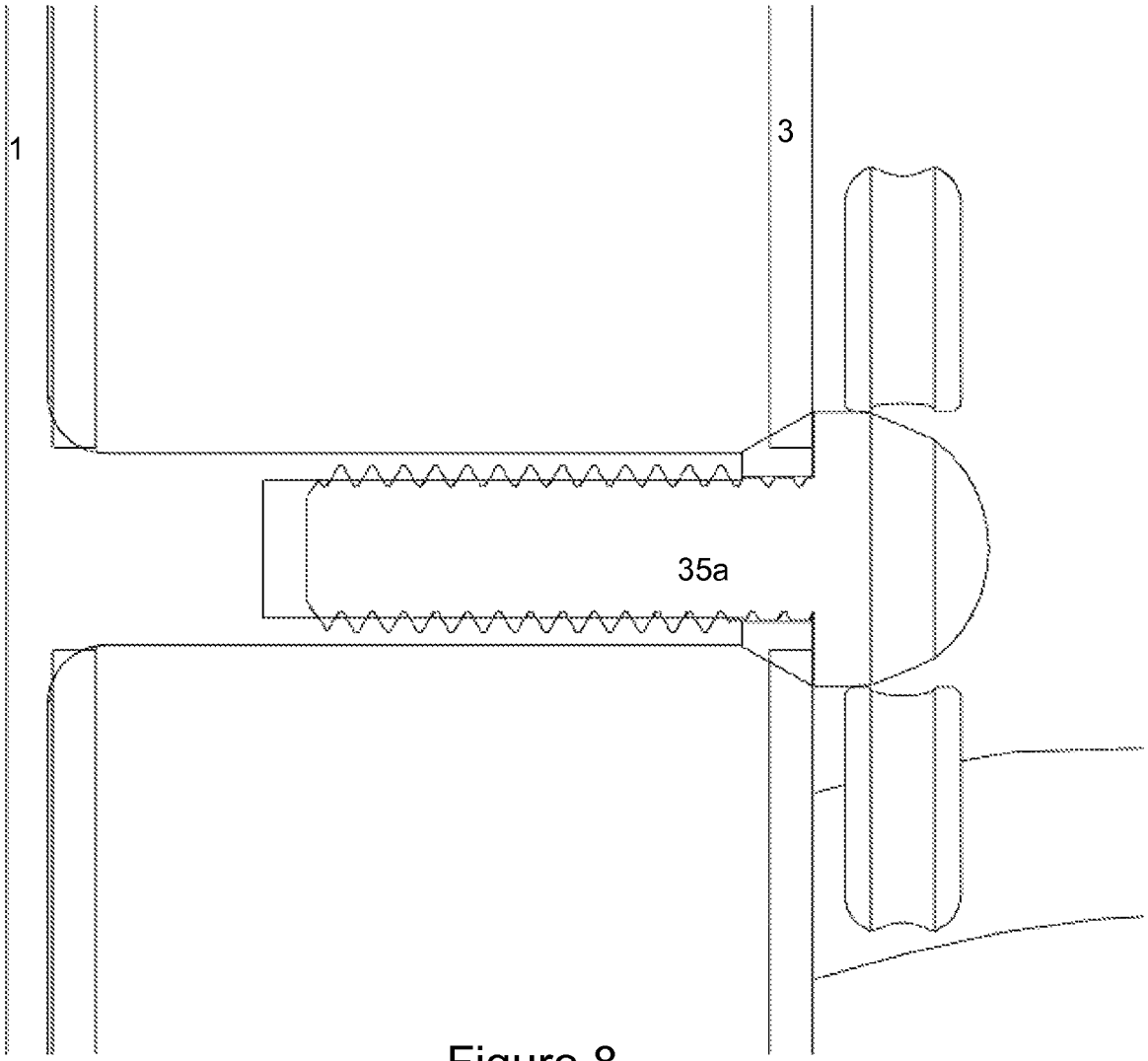
FIG. 8 depicts a cross section view of the threaded pin mounting mechanism with pin installed.

Another goal of the inventors is that the device be user installable/adjustable on existing crutches or user adjustable on new crutches. Thus the mounting mechanisms are preferably user installable/removable. FIGS. 6-8 show various implementations. FIG. 6 shows an exploded view of the grip assembly. The latch wraps completely around the crutch tube to provide maximum strength and support of the crutch. The latch consists of a metal strap that is thin and low profile. The metal strap has a built in pin that engages into the crutch hole. This provides maximum weight bearing ability. The latch consists of an over center toggle clamp that keeps pressure on the clamp to remain closed after clamping. The inside surface of the metal strap is overmolded with a rubber type material. This rubber does 3 things, provides compliance, prevents slipping, and prevents rattle noise. FIG. 7 shows a thumbscrew pin arrangement where pin 35*a* connects pole 1*a* to mechanism 34*a* in a manner known in the art, with a similar arrangement for pole 1*b*. FIG. 8 shows a cross-section of thumbscrew 35*a* used to connect pole and mechanism. Note that the pin is designed to take the entire weight of the user. To accomplish this, the weight is distributed on two components; the boss and the pin. The boss is integrated into the grip such that it has a very strong cross section. The boss can manufactured in a variety of ways such as, stamped, welded, molded or press fit. The pin is installed from the opposite side of the crutch tube hole, and can be tightened by the user to squeeze tightly onto the crutch. Once tightened, the load is evenly distributed along the entire surface area of the face of the clamp.

Figure 9:
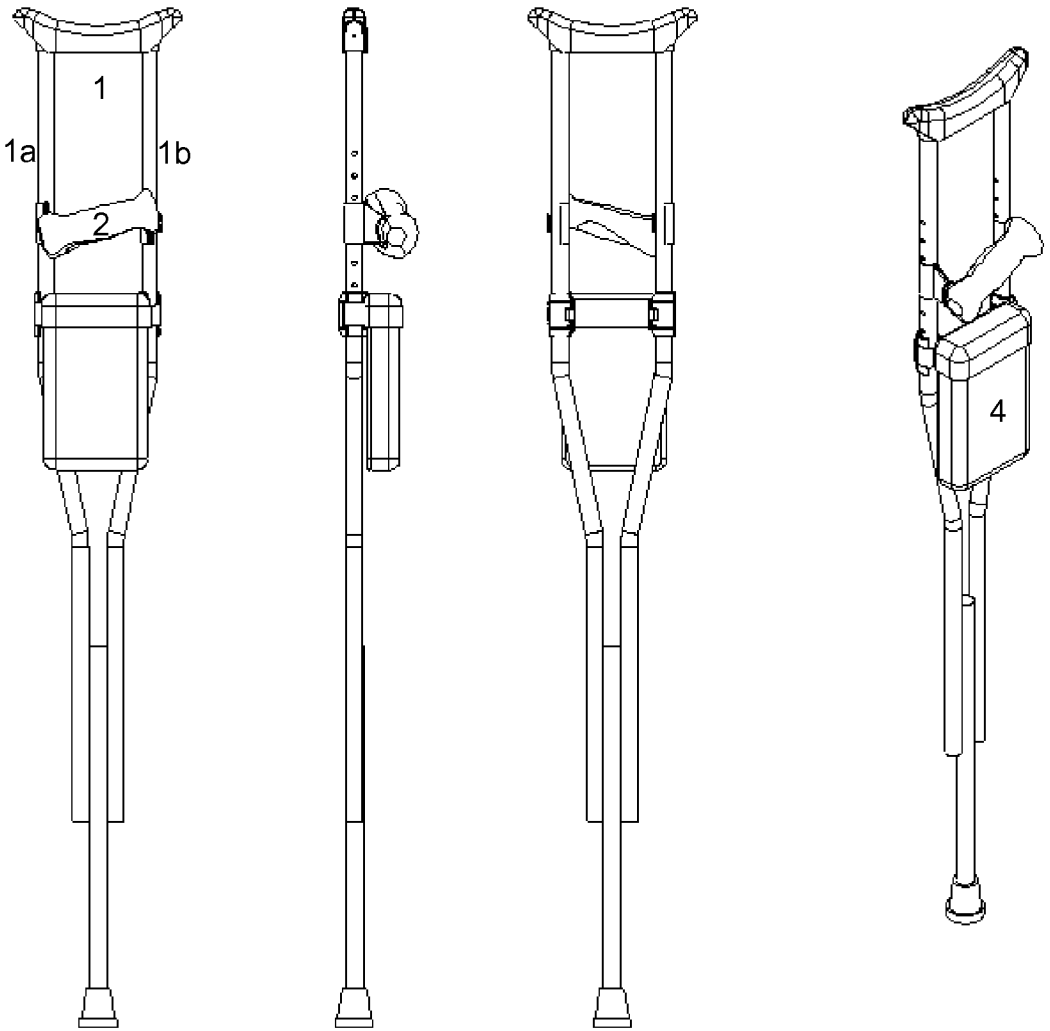
FIG. 9 shows various views of a crutch with the novel handgrip device installed and with optional carrying case.

FIG. 9 shows various views of a crutch 1 with the novel handgrip device installed. Also shown is an optional carrying case 4 or carrying case mount, which may also attach in the manner of the mechanisms shown in FIGS. 6-8. The carrying case can be manufactured with nylon, cotton, plastics, or neoprene or any combination of these materials. It's intended to carry items which a crutch user can not safely hold in their hands or under arms while crutching. The bag can connect via clamp or other means directly to the novel crutch grip.

Figure 10:
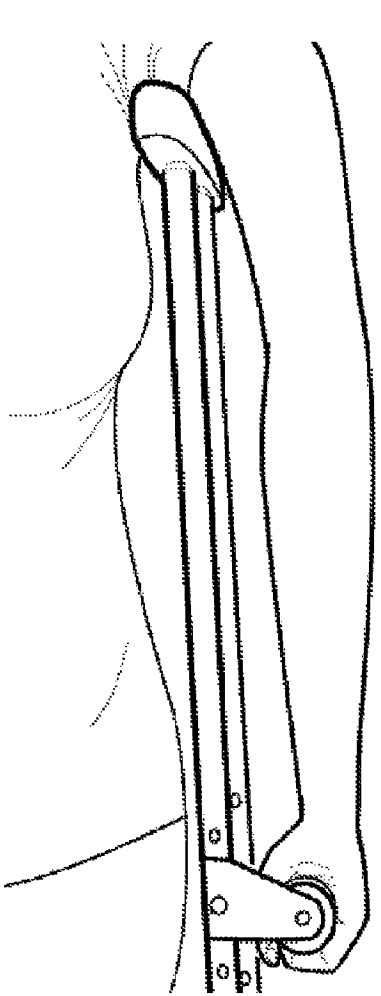
FIG. 10 shows the efficiency of the invention compared to normal crutch geometry which can be observed by the angle of the wrist and crutch.
Figure 10:
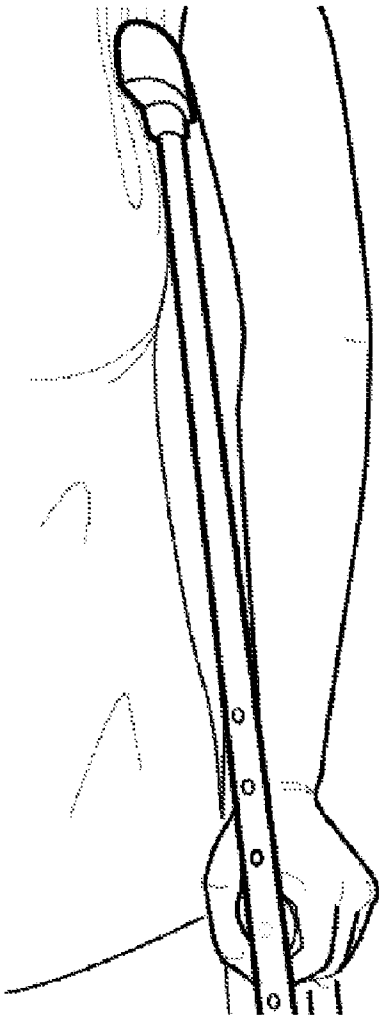
Figure 11:
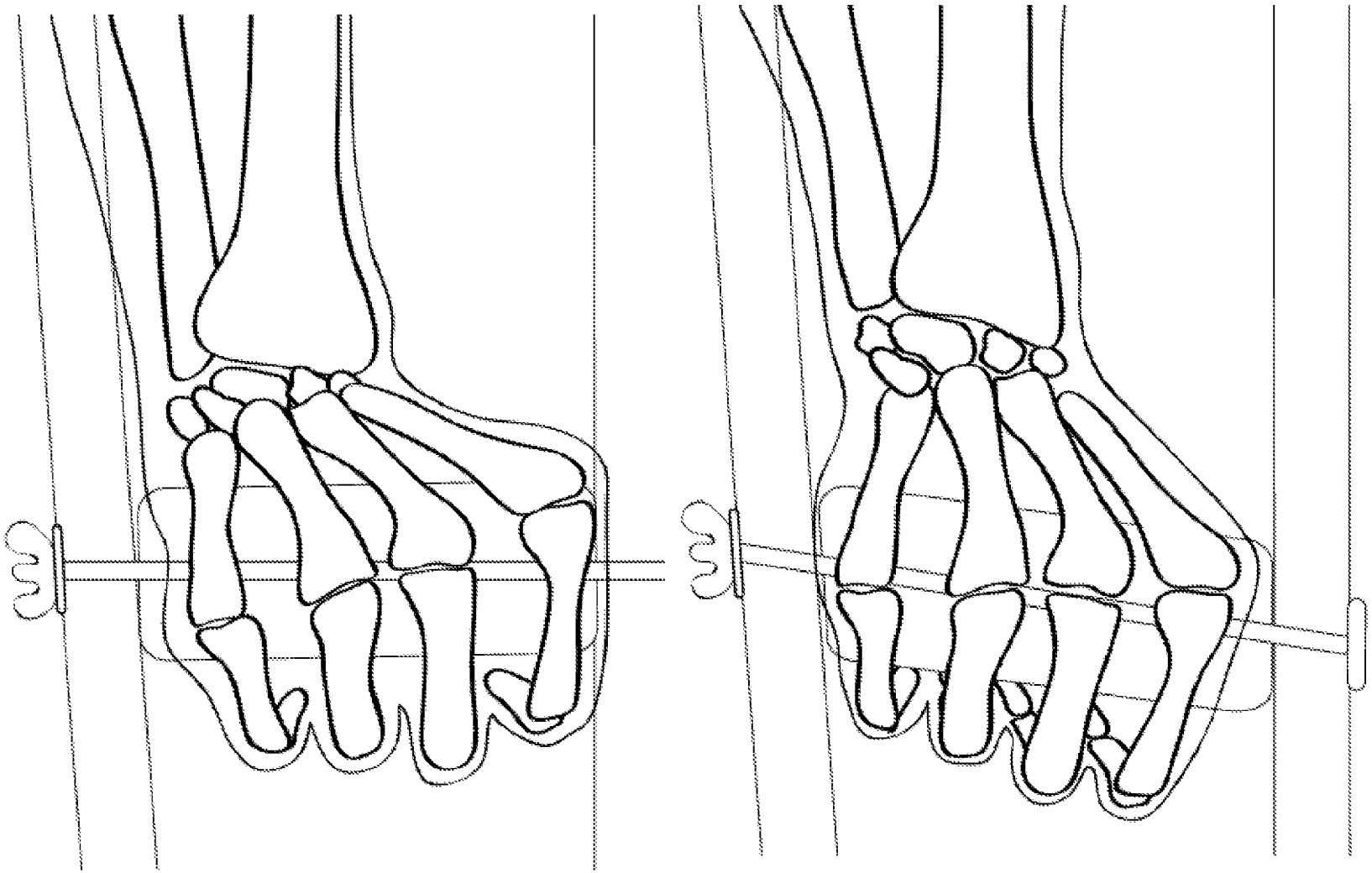
FIG. 11 is a side view of the actual internal bone and muscle alignment derived from an actual x-ray image using the novel handgrip device compared to a normal crutch handgrip.
Figure 12:
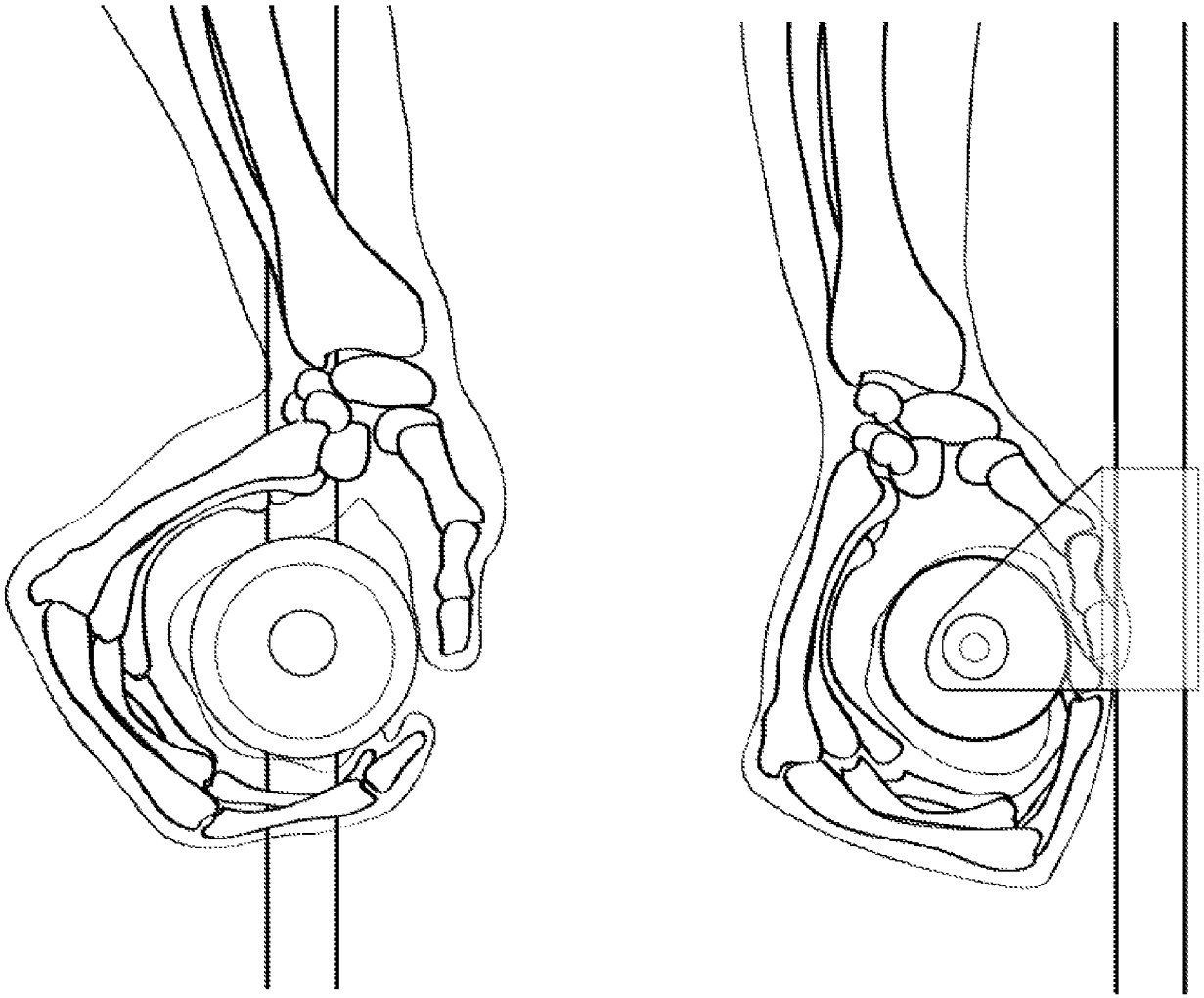
FIG. 12 is a front view of the actual internal bone and muscle alignment derived from an actual x-ray image using the novel handgrip device compared to a normal crutch handgrip.

FIGS. 10-12 illustrate the specific benefits achieved by the novel handgrip device compared to conventional crutch handgrips.

In FIG. 10*a* the arm and forearm are forced to fit between the two crutch poles while the hand holds on to the standard crutch grip. To bear weight the hand is forced to roll to a back extreme angle compared to the position of the arms vertically above. This angle hyper flexion puts muscles connected to tendons along with nerves into an unnatural position. This unnatural position is exasperated with added vertical pressure from the body's full weight during the crutch gate.

In FIG. 10*b* the arm and forearm are in a neutral position. The arms are allowed to reside outside the crutch poles. The muscles, tendons and nerves within the wrist are in a neutral non-flexed position while holding the novel hand grip just as the arm would hang from the side normally.

FIG. 11*a*, derived from an x-ray image, is an outboard side view of a right hand holding a normal standard crutch handle. Note that the metacarpals are almost at a horizontal angle from the ground. This angle is caused by the wrist's hyperflexion to reach between the two poles on a conventional crutch to support weight during crutch gait. Note the carpal bones are also grouped in an unnatural proximity to each other putting pressure on tendons, bone and nerves. FIG. 11*b*, derived from an x-ray image, is an outboard side view of the right hand holding the novel crutch handle. The metacarpals are at a greater vertical plain and there is a clear view of the carpal bones in a neutral position with neutral spacing between them. This clear view shows that the tendons, muscles and nerves are in a natural healthy spacing. This neutral position follows through a normal crutch gait.

FIG. 12*a*, derived from an x-ray image, is a front view of the right hand holding the conventional 90 degree hand grip. The radial and ulna bones are forced to point at an inward angle to the body so that the arms can avoid the crutch poles and position the hands to hold onto the grip. The wrist is at an almost 90 degree hyper flexed position to the ulna and radial bones. This hyperflexion puts an unnatural strain on the muscles, tendons, and nerves in the carpal bone area. FIG. 12*b*, derived from an x-ray image, is a front view of the right hand holding the novel crutch hand grip. The radial and ulna bones are at a vertical horizontal position from the crutch poles and body. The metacarpals are also in a more vertical position relieving the wrist from hyperflexion. The wrist is in neutral position without flexion with thumbs pointing slightly downward and inward toward the body.

FIG. 13*a* shows the palm of the hand with a conventional straight grip handle. The straight grip connects and passes along the bearing weight of the crutch to the bottom of the hand crossing from the top of the second metacarpals (pointing finger) toward the back portion of the fifth metacarpal (little finger). FIG. 13*b* shows the front of hand with a curved grip. This curve follows the natural bone structure of the metacarpals. This allows for less effort from the user and more support while the proximal phalanges are able to comfortably contract toward the grip. The anatomy of the human hand is not straight, rather it is curved. Hence, the curved grip ergonomically matches the natural shape of the hand.

Figure 18:
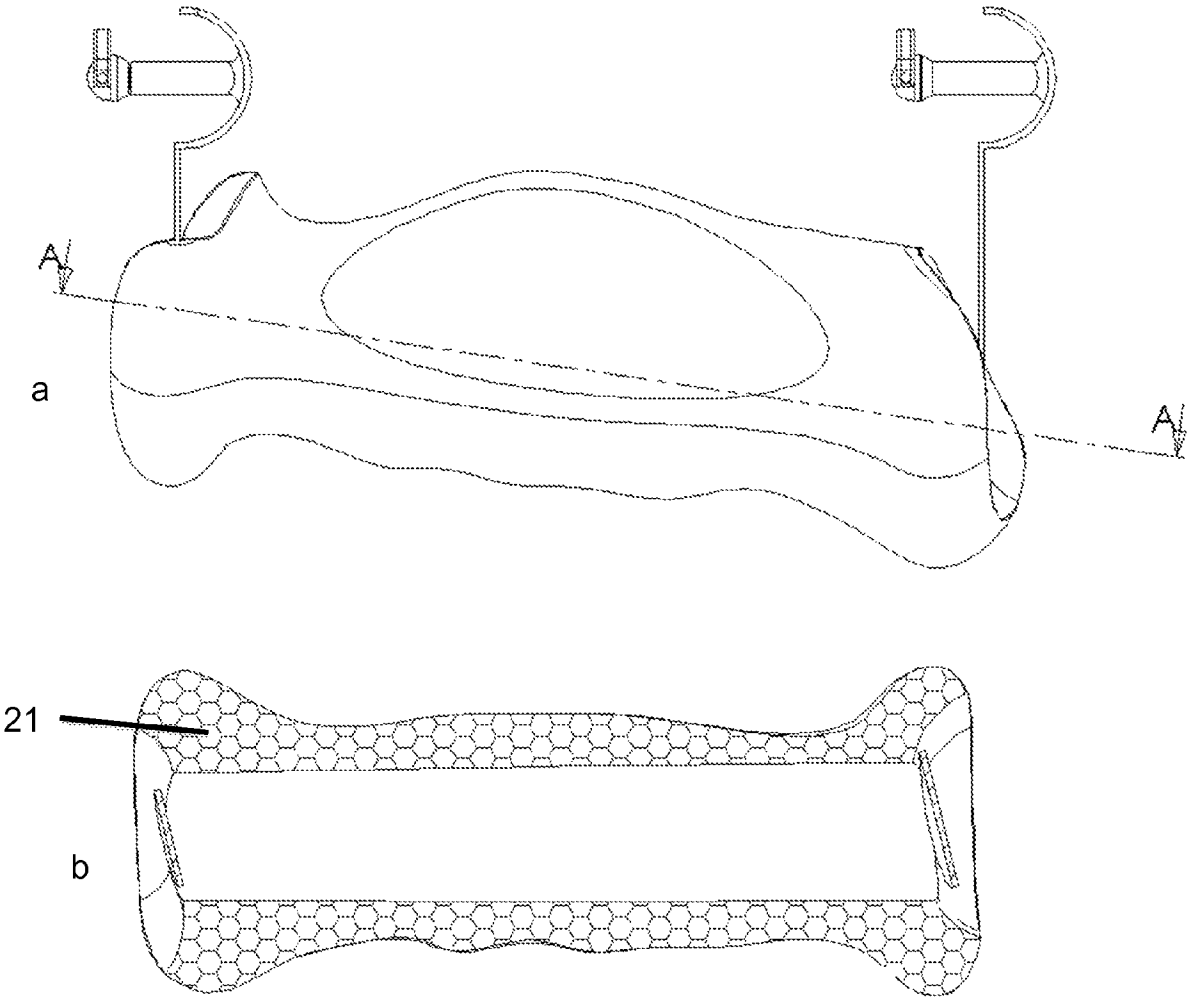
FIG. 18 depicts the novel handgrip looking from straight above with grip on and cross section which shows single density grip cushion.
Figure 19:
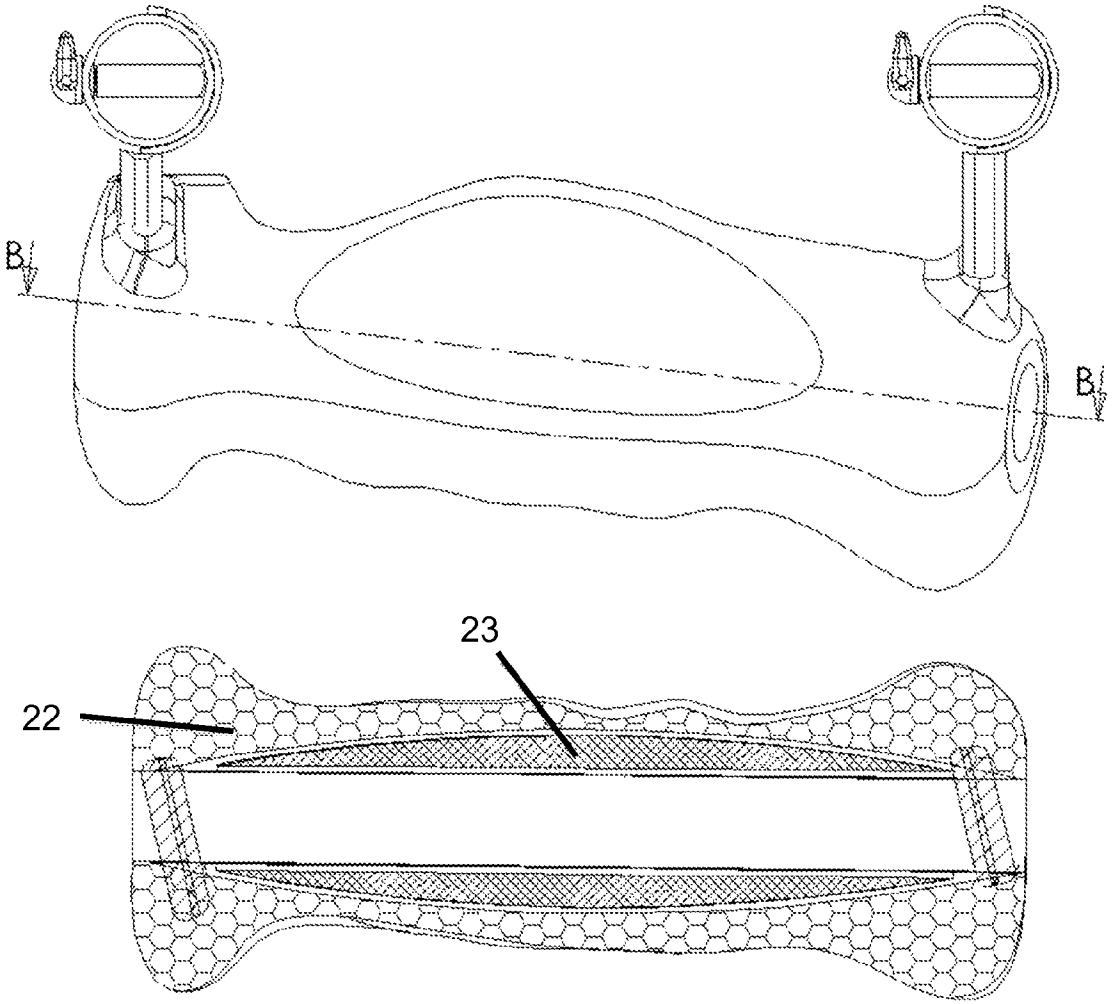
FIG. 19 depicts the novel handgrip looking from straight above with grip on the cross section which shows a multi density grip.
Figure 20:
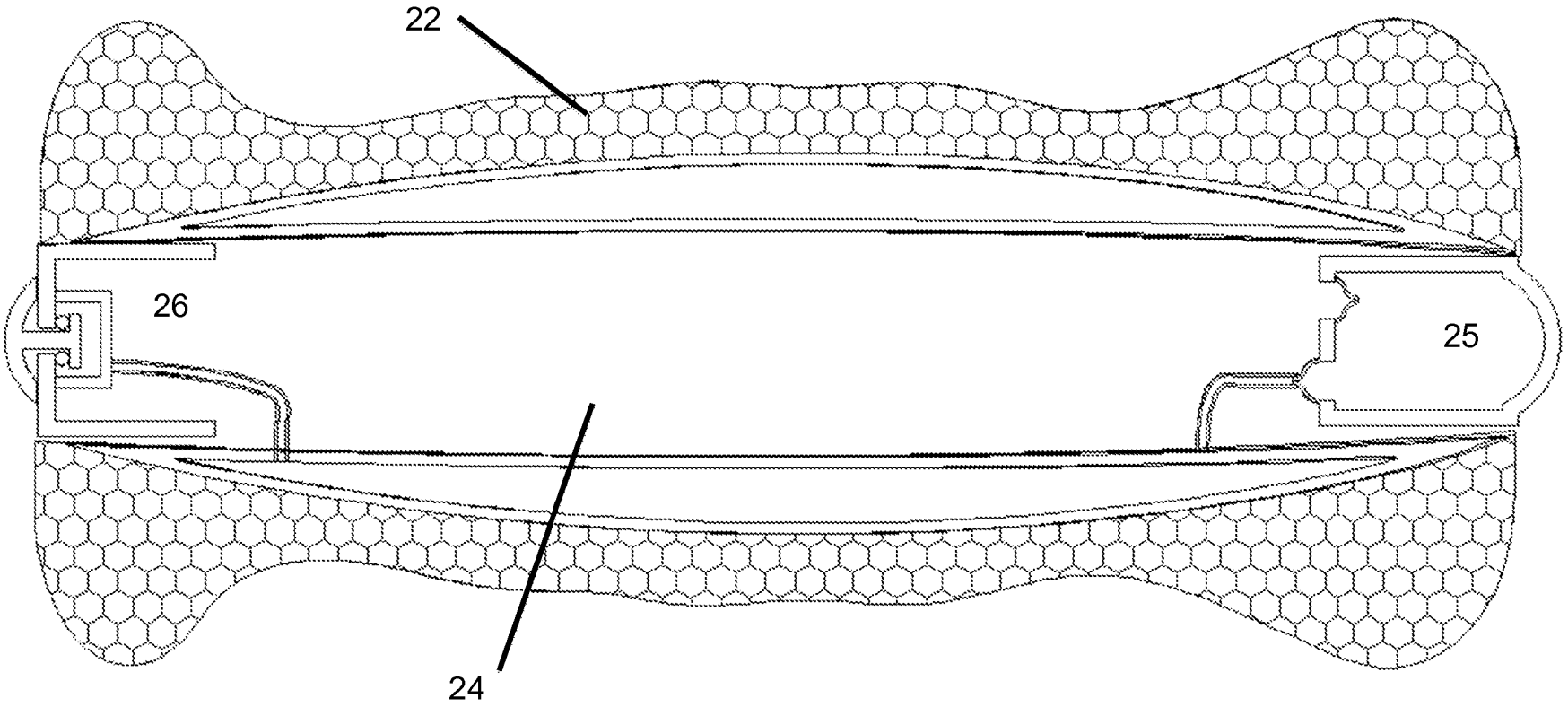
FIG. 20 shows an embodiment of the grip with user pumpable/vent-able internal air bladder.
Figure 21B:
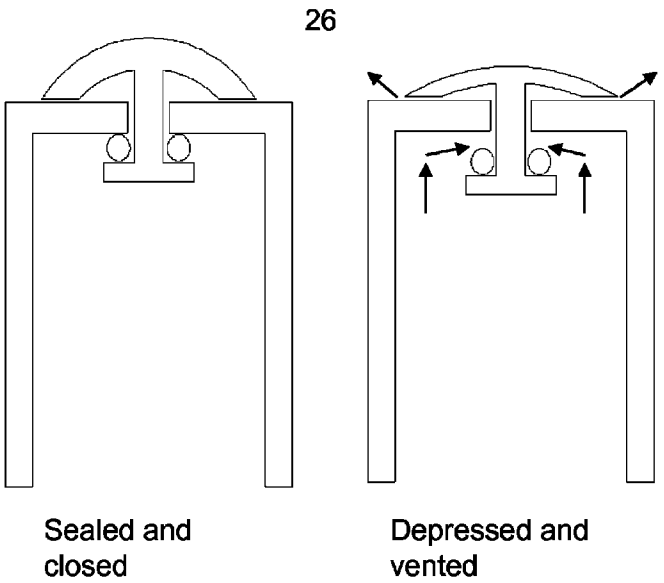
FIGS. 21*a* and 21*b* depict details of an exemplary pump and an exemplary vent for the embodiment of FIG. 20.
Figure 21A:
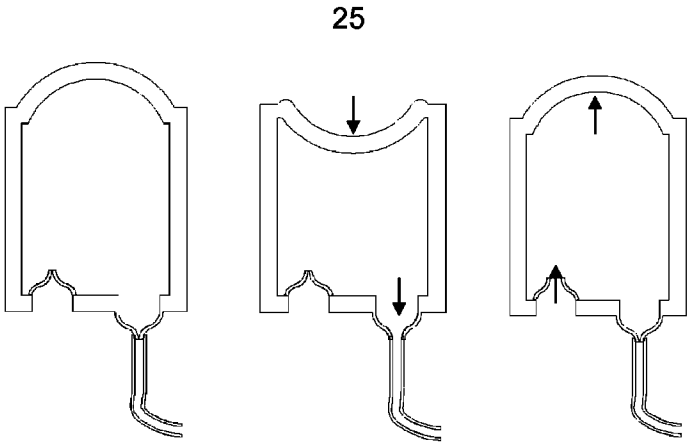

FIG. 18*a* illustrates the cross section of an exemplary ergonomic grip shape. The integration of the curved hand grip inner support geometry results in an improved placement of the hand grip. This correct position allows for a more efficient interface between the hand and the foam hand grip. The hand grip cushioning 21 is designed such that it fills the space between the varying complex surfaces of the human hand. FIG. 18*b* illustrates one version of the ergonomic grip cushioning 21 where the cushioning is all of one density FIG. 19 illustrates a multiple density cushioning arrangement. Outer cushioning 22 in contact with the hand may be of a softer or lower density type for comfort while inner cushioning 23 may be stiffer or higher density for better weight bearing. Likewise the inner may be of softer density while the outer may be of stiffer density. The novel aspect to the density differences can be accomplished by an adjustable air bladder. Air may be added to the bladder within the grip for a stiffer density grip or it may be released for a softer density grip. An exemplary implementation of the novel handgrip is the inclusion of full ergonomic support comprising with an outer or inner foam 22 and a subsequent inner or outer bladder liner 24. The liner includes at least one inflatable air compartment with at least one inflatable air pump 25. A self-contained air pump is mounted to the crutch support at either the front or rear of the handle. The pump is activated via a depression by finger or thumb which will allow the user to inflate or deflate the inner liner of the grip while in use. The pump is in constant engagement with the air compartment or compartments. Air pump 25 is filled with air from outside the grip by way of a one way duck bill check valve which is well known to those skilled in the art. Outside air flows to the inside liner bladder 24 when the depression or tab portion of air pump 25 is depressed, or otherwise pushed inward toward the grip with a finger tip. Outside air pulled into pump through check valves to air compartment 24. When tab button is depressed again air from the pump compartment is pushed into liner bladder via duck bill valve exit valve is forced closed so that no air escapes. Repeated depression of the air pump causes the air compartment 24 to fill with outside air and become filled to the desired volume of air. Depressible vent 26 is used to deflate the bladder. FIGS. 21*a* and 21*b* show details of operation of exemplary pump 25 and exemplary vent 26.

The foregoing description of the embodiments of the present invention has shown, described and pointed out the fundamental novel features of the invention. It will be understood that various omissions, substitutions, and changes in the form of the detail of the systems and methods as illustrated as well as the uses thereof, may be made by those skilled in the art, without departing from the spirit of the invention. Consequently, the scope of the invention should not be limited to the foregoing discussions, but should be defined by appended claims.

We claim:

1. A handgrip device for an ambulation assistance crutch, wherein the crutch has two support poles extending from the top of the crutch downward toward the ground comprising;

a handgrip element; and, one handgrip element support pole attachment mechanism for each pole, comprising a pole attachment end, a handgrip end and an offset distance between the two ends wherein the handgrip element connects to the mechanisms on one end, and an opposite end of the mechanisms attaches to the poles whereby the handgrip element is spaced away from the poles by the offset distance of the mechanisms which are bridged by the handgrip element, wherein;

the attachment mechanisms are user installable and removable, and provide for an independent front and rear extension of the handgrip element spaced outboard from the plane of the poles away from the body side of the crutch by independent front and rear offset distance, the offset distance from the forward tube (thumb end) end of the handgrip is less than the offset distance from the rear tube, when installed on the crutch, the vertical positioning of the forward end of the handgrip is lower to the ground from then the back end vertical positioning of the handgrip; and, the handgrip is curved outward relative to the plane of the support poles.

2. The handgrip device of claim 1 wherein the offset distance from the forward tube is in the range of 0.5" to 2.5".

3. The handgrip device of claim 1 wherein the offset distance from the forward tube is 1.33"+/−0.5".

4. The handgrip device of claim 1 wherein the offset distance from the rear tube is in the range of 1.0" to 3.0".

5. The handgrip device of claim 1 wherein the offset distance from the rear tube is 1.95"+/−0.5".

6. The handgrip device of claim 1 wherein the angle of the handgrip element due to the difference between the back and front end vertical positioning is between 5 and 20 degrees down from rear to front.

7. The handgrip device of claim 1 wherein the handgrip element has a radius of curvature between 5 and 50 inches.

8. The handgrip device of claim 1 wherein the handgrip is at least one of made or encased in a molded ergonomic grip shape for improved weight distribution.

9. The handgrip device of claim 1 wherein the handgrip can be adjusted to hand dimension comfort and support via an inflatable air bladder.

10. The handgrip device of claim 1 wherein the device is user installable and removable without tools.

11. The handgrip device of claim 1 wherein the angle of the handgrip element due to the difference between the back and front end vertical positioning is 14+/−1 degrees down from rear to front.

* * * * *